US007441987B1

(12) United States Patent
Sampey

(10) Patent No.: US 7,441,987 B1
(45) Date of Patent: Oct. 28, 2008

(54) CURBING MACHINE AND METHOD

(76) Inventor: Larry Sampey, 1496 Evergreen Ave., Morgan City, LA (US) 70380

( * ) Notice: Subject to any disclaimer, the term of this patent is extended or adjusted under 35 U.S.C. 154(b) by 206 days.

(21) Appl. No.: 11/349,726

(22) Filed: Feb. 7, 2006

Related U.S. Application Data

(60) Provisional application No. 60/650,471, filed on Feb. 7, 2005.

(51) Int. Cl.
*E01C 11/22* (2006.01)
*E01C 19/00* (2006.01)

(52) U.S. Cl. ..... 404/98; 404/83; 404/86; 404/108; 404/110

(58) Field of Classification Search ..... 404/98, 404/96, 105, 108, 83, 86, 110
See application file for complete search history.

(56) References Cited

U.S. PATENT DOCUMENTS 3,749,505 A * 7/1973 Miller et al. ..... 404/98
3,779,662 A * 12/1973 Smith ..... 404/98
3,954,359 A * 5/1976 Larkin ..... 425/63
4,298,293 A * 11/1981 Baucom ..... 404/98
4,391,549 A * 7/1983 Murray ..... 404/87
4,789,266 A * 12/1988 Clarke et al. ..... 404/96
4,808,026 A * 2/1989 Clarke et al. ..... 404/90
5,051,025 A * 9/1991 Taylor, Jr. ..... 404/98
5,173,005 A * 12/1992 Henderson et al. ..... 404/98
5,662,431 A * 9/1997 Colvard ..... 404/105

* cited by examiner

*Primary Examiner*—Thomas B Will
*Assistant Examiner*—Alina Schiller
(74) *Attorney, Agent, or Firm*—Garvey, Smith, Nehrbass & North, L.L.C.; Charles C. Garvey, Jr.; Seth M. Nehrbass

(57) ABSTRACT

A method and apparatus for laying a curb is disclosed. The apparatus features a preferably tracked vehicle (tractor) that connects to a frame having a hopper. A hydraulic lifting arrangement enables hydraulic controls on the vehicle to elevate/lower the frame. The frame has a hopper for receiving wet concrete and a curb shaping portion that shapes the wet concrete into a curb shape. A specially configured interface maintains attitude of the frame during use.

22 Claims, 7 Drawing Sheets

CURBING MACHINE AND METHOD

CROSS-REFERENCE TO RELATED APPLICATIONS

Priority of U.S. Provisional Patent Application Ser. No. 60/650,471, filed Feb. 7, 2005, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to concrete curb forming machines. More particularly, the present invention relates to an improved method and apparatus for forming concrete curbs wherein a motorized, preferably tracked excavator supports a frame with an improved interface at a lateral "outrigger" position, the frame having a vertically extended hollowed hopper that receives wet concrete at an upper opening and discharges the wet concrete to a curb shaping portion at a lower opening, a special optional guide arrangement aiding an operator to track a desired path during formation of the curb.

2. General Background of the Invention

Devices that form concrete curbs or curbing are known. Examples of such devices are seen in the patents listed in the following table, each patent listed being incorporated herein by reference.

TABLE

| PATENT NUMBER | TITLE | ISSUE DATE |
|---|---|---|
| 1,334,483 | Tool for Shaping or Forming Cement Curbs and Gutters | Mar. 23, 1920 |
| 3,108,518 | Curb and Gutter Formers | Oct. 29, 1963 |
| 3,749,505 | Concrete Curb Laying Machine | Jul. 31, 1973 |
| 3,779,662 | Curb Slip Form Apparatus | Dec. 18, 1973 |
| 3,954,359 | Apparatus for the Continuous Casting of Concrete | May 4, 1976 |
| 4,391,549 | Expansion Joint Inserter for Continuous Curb Laying Machines | Jul. 5, 1983 |
| 5,173,005 | Prime Mover Actuated Concrete Curb Extruder | Dec. 22, 1992 |
| 5,662,431 | Self-Propelled Slip-Form Paving Apparatus | Sep. 2, 1997 |

BRIEF SUMMARY OF THE INVENTION

The present invention provides an apparatus for forming elongated concrete curbs. The apparatus includes a frame having front and rear portions, the frame supporting a hopper having upper and lower end portions. The hopper provides a hollowed interior that includes upper and lower openings.

The frame has an curb shaping portion that extends from the lower end of the hopper next to the lower opening. A motor driven vehicle (e.g. tractor) is provided for moving the frame along the selected path, the tractor can have a liftable portion (e.g. hydraulically operated) that is movable between lowered and elevated positions.

The liftable portion of the vehicle can thus elevate and lower the frame.

An interface connects the frame to the vehicle in a manner that supports the hopper wall in a proper attitude during curb forming operations.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
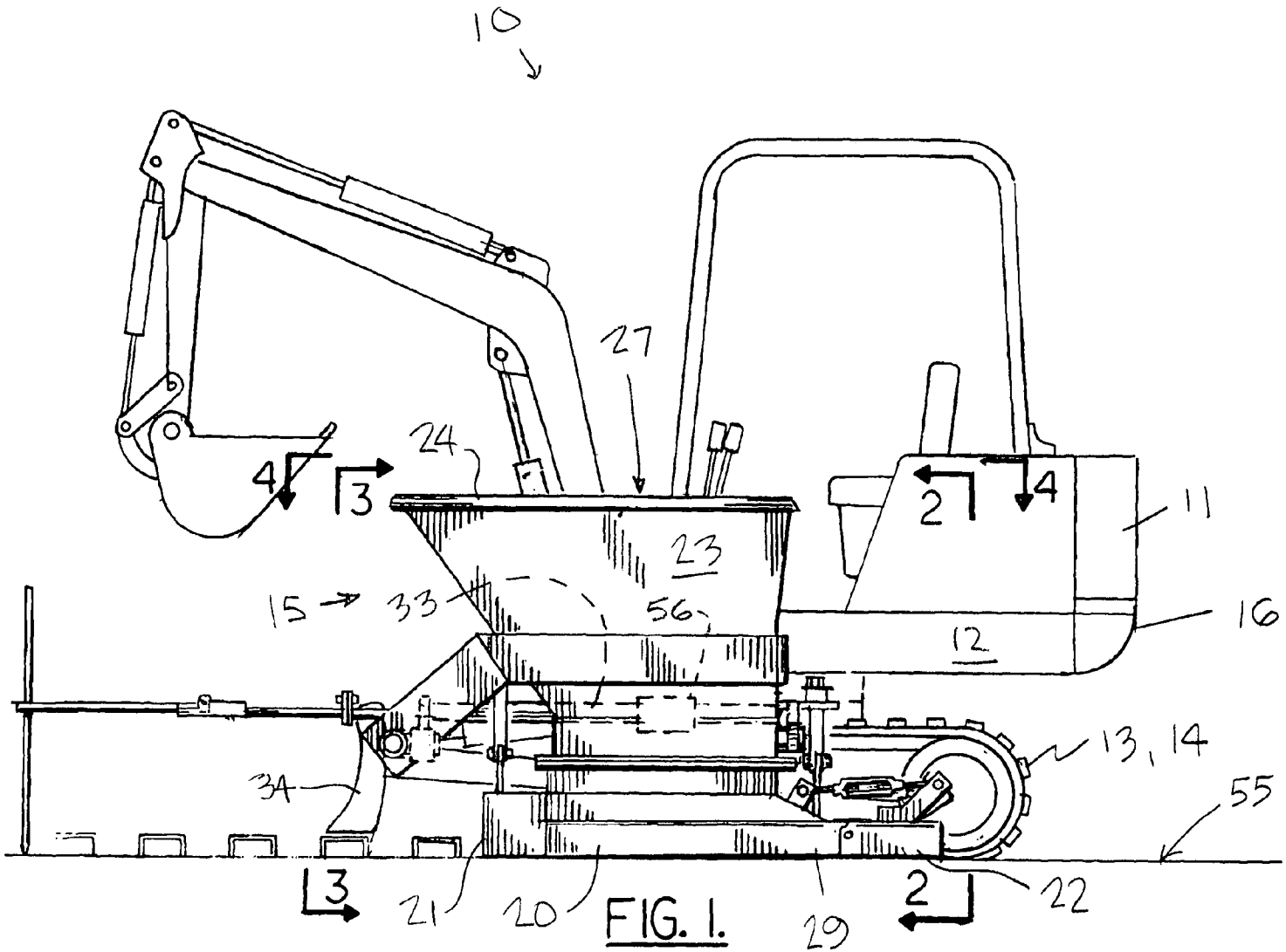
FIG. 1 is a perspective view of the preferred embodiment of the apparatus of the present invention.

In FIGS. 1-9 of the drawings, curb forming machine or curbing machine 10 utilizes a self propelled vehicle (e.g. tracked) such as an excavator or tractor 11 that can have a motor driven frame 12 and a ground engaging interface provided for example by endless tracks such as the left track 13 and right track 14 shown. Tractor 11 can for example be a Bobcat® model 325 mini-excavator or the like.

Vehicle 11 has front end portion 15, rear end portion 16 and a mounting plate 17 that releasably attaches to frame 12 at a position next to left track 13.

The mounting plate 17 provides a T-shaped socket 18 that forms a connection with correspondingly shaped hanger 19. Hanger 19 can be comprised of horizontal flange 19A and vertical flange 19B. Vertical flange 19C joins horizontal flange 19A to bushing 56. In order to disconnect, a user simply lowers blade 34 and moves vehicle 11 until plate 17 and socket 18 receives hanger 19 (see arrow). To engage, this procedure is reversed. Set screws 67 can be used to secure hanger 19 to plate 17 (see FIG. 6). The hanger 19 connects to frame 20 at bushing 56 and rod 33. Frame 20 is a frame that receives wet concrete via hopper 23 and shapes that wet concrete into a curb shape in continuous fashion as tractor 11 advances along a selected path, continuously forming a curb C.

Frame 20 has front end portion 21, rear end portion 22 and hopper 23. Hopper 23 has upper end portion 24, lower end portion 25 and a hollowed interior 26 for receiving wet concrete that can for example be transferred to the hopper 23 upper end portion 24 using a cement mixer vehicle or truck 62 (see FIG. 8) having a delivery chute 63. Hopper 23 provides upper opening 27 and lower opening 28. The upper opening 27 is at upper end portion 24 and receives wet concrete. The lower opening 28 communicates with curb forming section 29.

Figure 2:
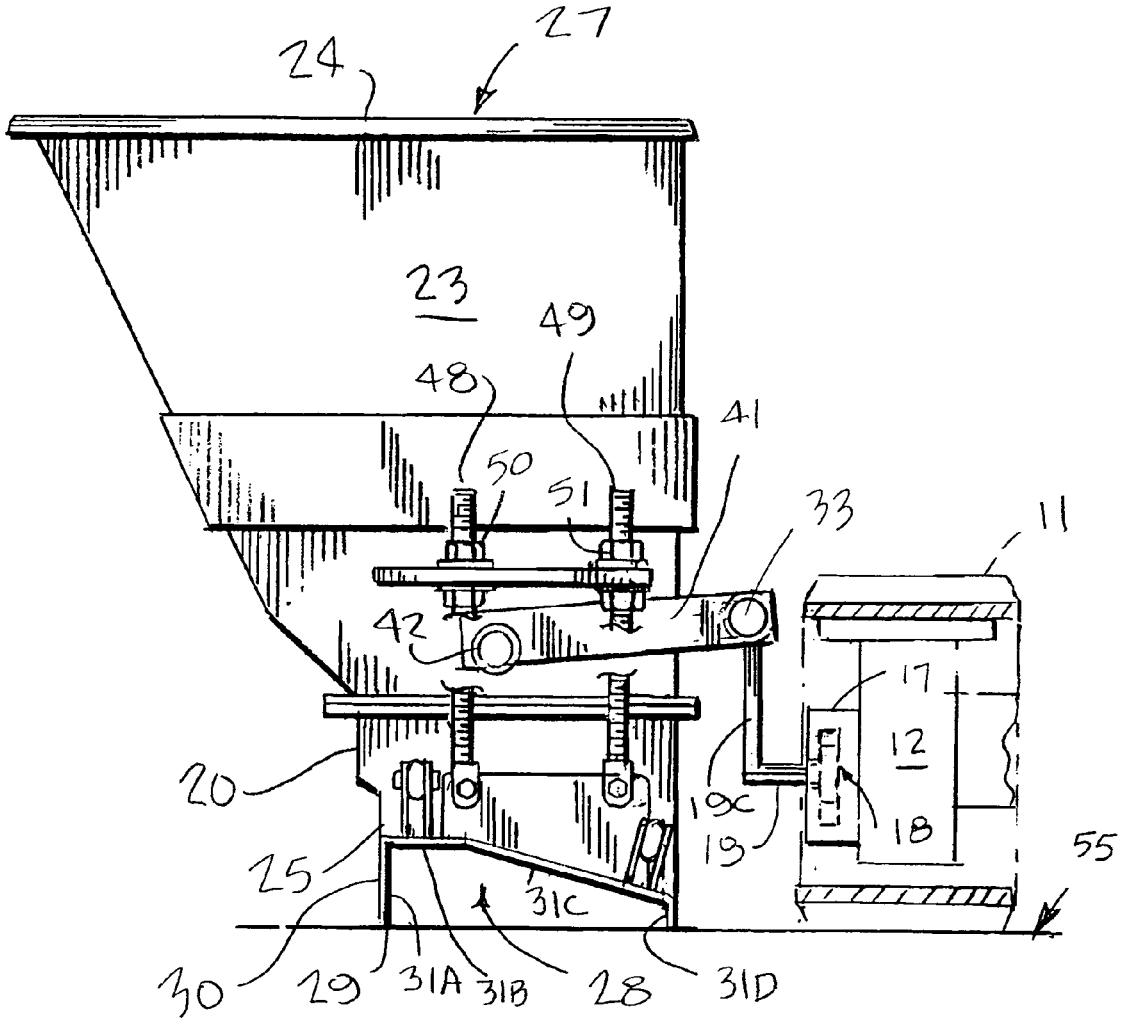
FIG. 2 is a rear view of the preferred embodiment of the apparatus of the present invention.
Figure 8:
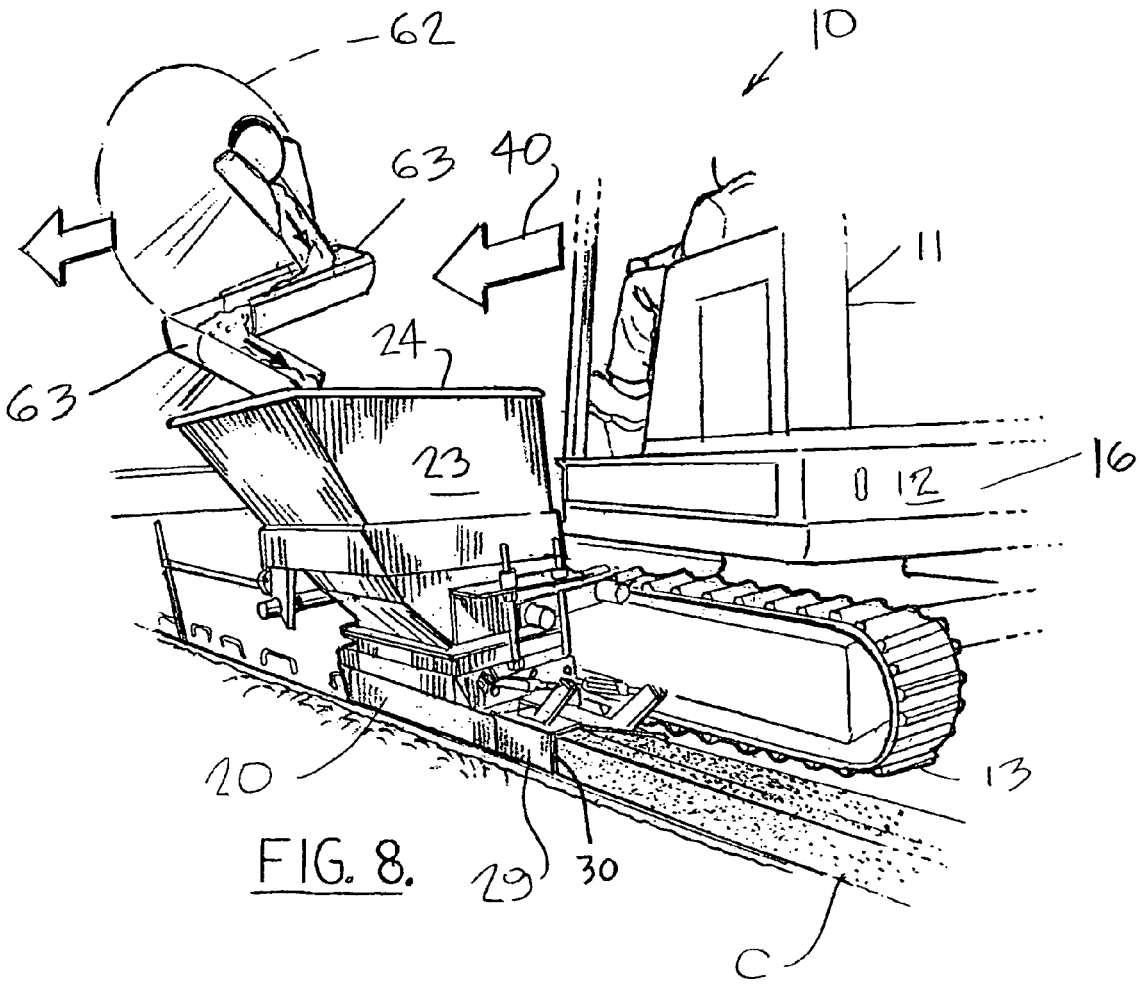
FIG. 8 is a rear perspective view of the preferred embodiment of the apparatus of the present invention.

In FIG. 2, the curb forming section 29 includes a shaped plate 30 that is shaped to produce a curb having a substantially uniform cross section. The curb transverse cross sectional shape is defined by the shape of the plate 30 as vehicle 11 moves forward, as best seen in FIGS. 2 and 8. The shaped plate 30 is comprised of plate sections 31*a*, 31*b*, 31*c*, 31*d*.

At the front end portion 21 of frame 20, a cylindrical bushing 32 extends transversely, being generally perpendicular to left track 13, right track 14 and the central longitudinal axis of tractor 11. Bushing 32 carries rod 35. Transverse rod 35 connects to a hydraulic lifting device on tractor 11 such as for example blade 34. Rod 32 attaches to blade 34 at sleeve 65, secured with bolt 66 or a bolted or welded connection. Transverse bushing 32 is connected to and a part of frame 20, being attached to forward, diagonally extending strut 52.

When blade 34 is elevated, transverse rod 35 and transverse bushing 32 are also elevated. In order to insure that frame 20 maintains a desired attitude with respect to an underlying support surface 55, longitudinal rod 33 connects to the front end portion 21 and rear end portion 22 of frame 20 using front arm 37, front bushing 38, rear arm 41, and rear bushing 42. The front arm 37 and bushing 38 are attached to bushing 32. Rear arm 41 and bushing 42 attach to rear end portion 22 of frame 20. Cylindrical, longitudinal bushing 56 is at a fixed elevation, being rigidly attached to hanger 19 of tractor 11 (see FIGS. 6-7).

Figure 3:
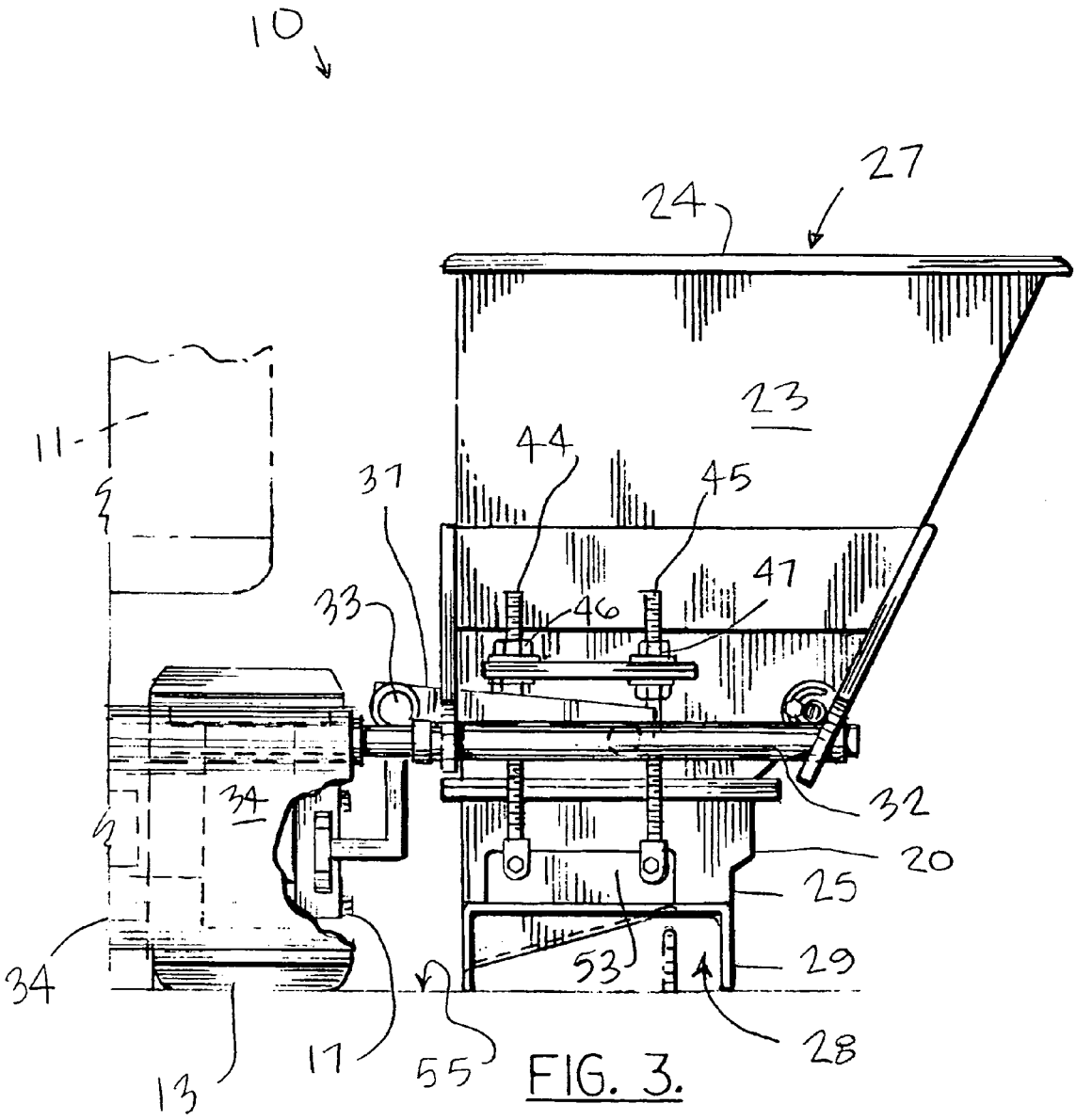
FIG. 3 is a front view of the preferred embodiment of the apparatus of the present invention.
Figure 4:
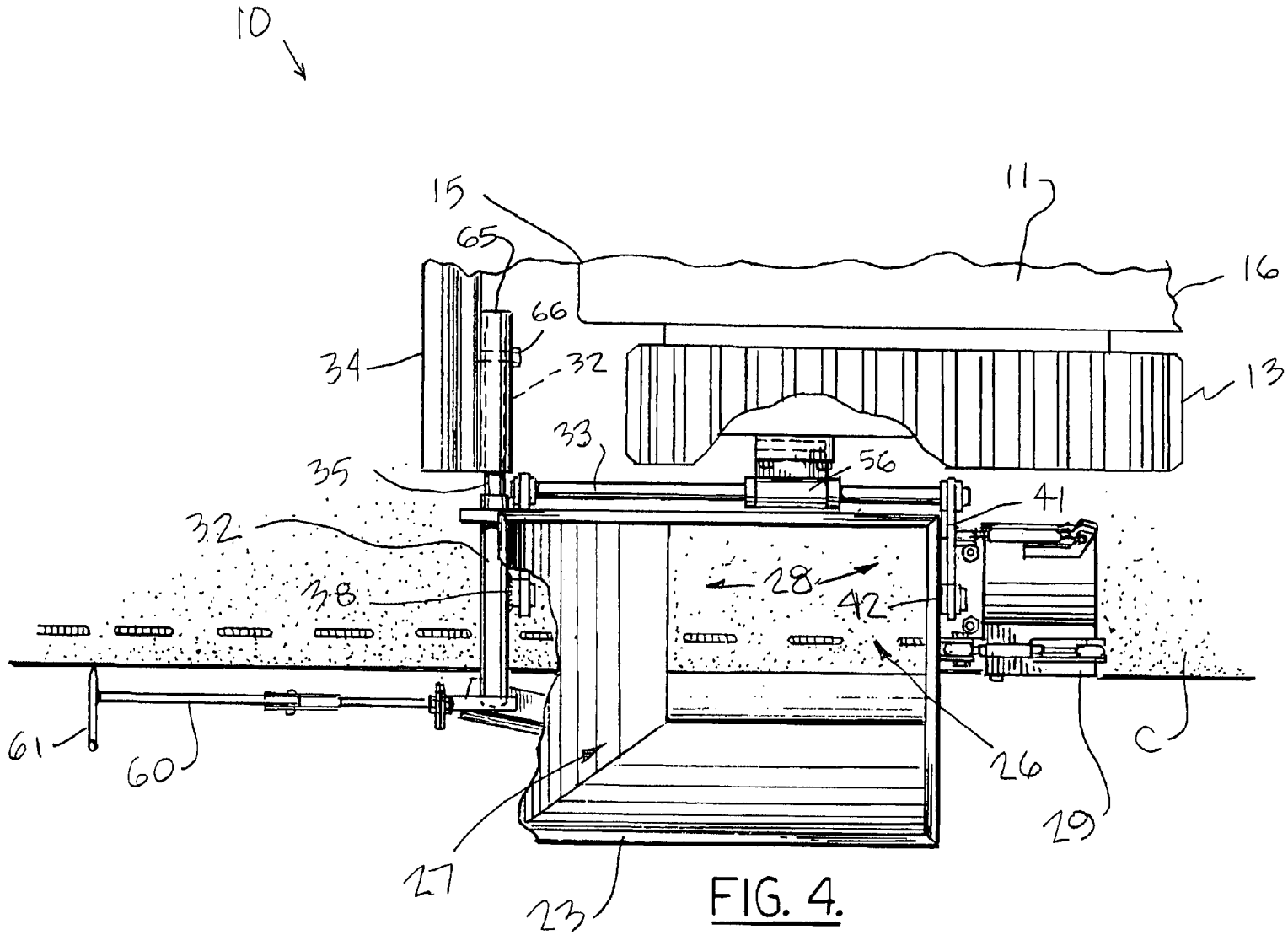
FIG. 4 is a top view of the preferred embodiment of the apparatus of the present invention.
Figure 5:
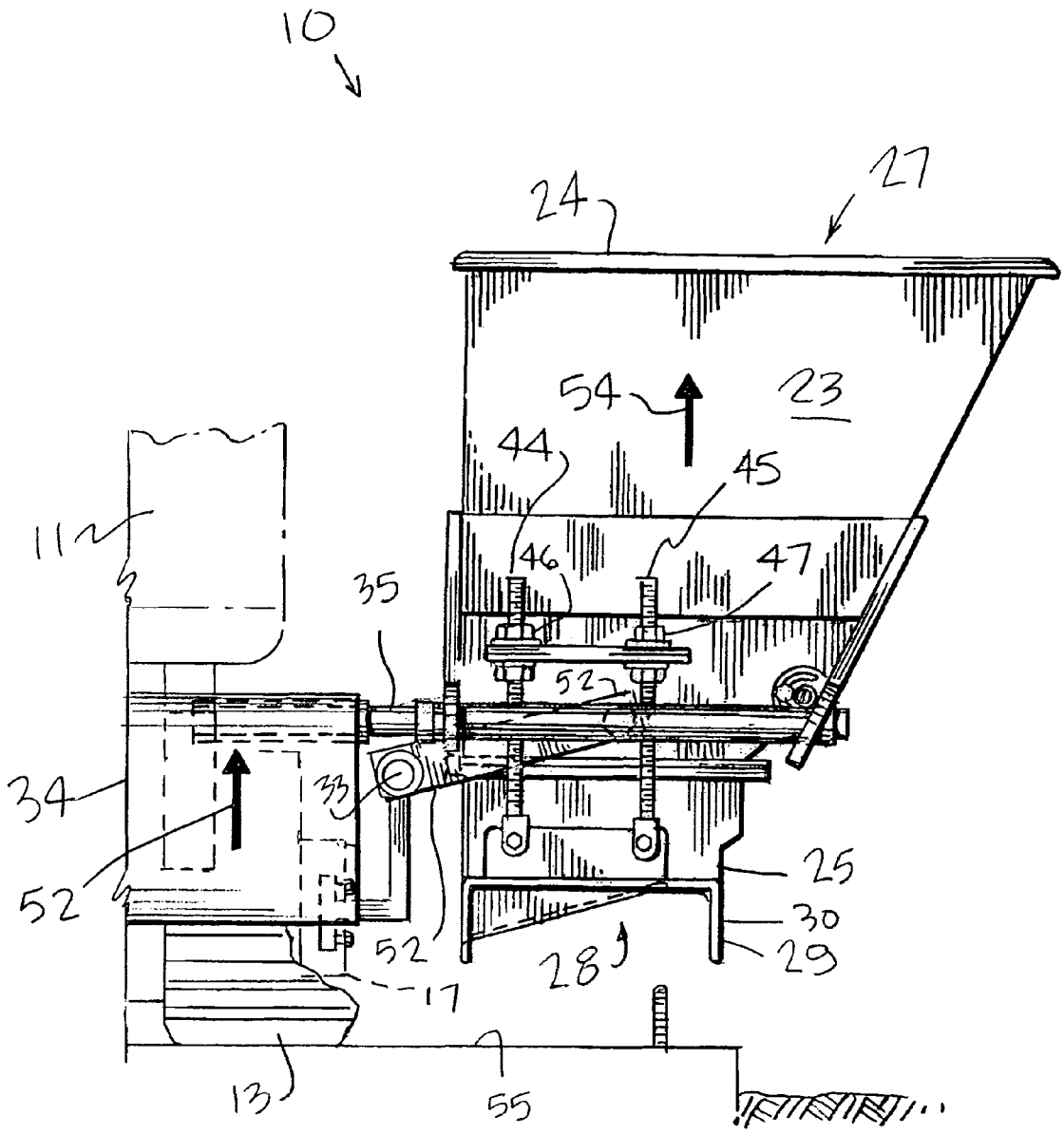
FIG. 5 is a front view of the preferred embodiment of the apparatus of the present invention.
Figure 6:
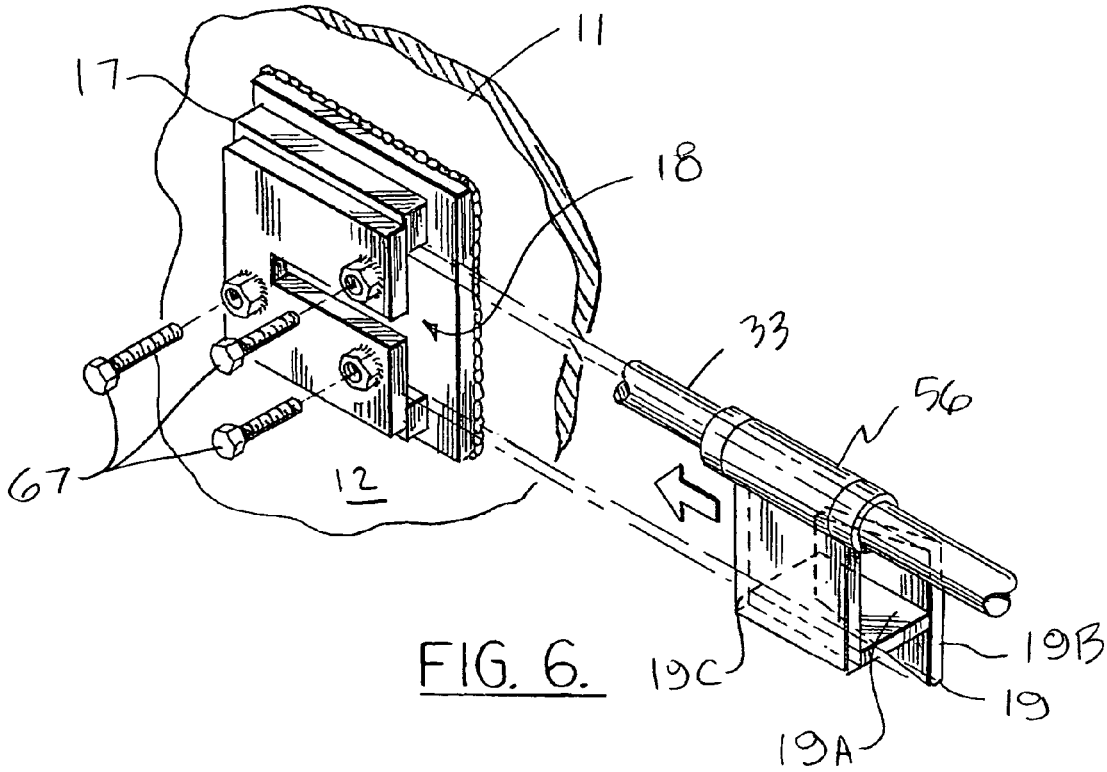
FIG. 6 is a fragmentary perspective view of the preferred embodiment of the apparatus of the present invention.
Figure 7:
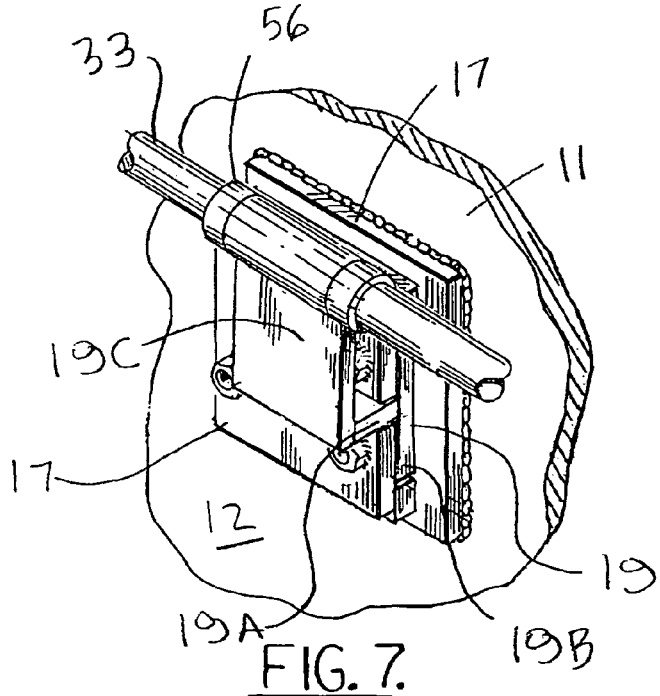
FIG. 7 is a fragmentary perspective view of the preferred embodiment of the apparatus of the present invention.

When blade 34 and rod 35 are elevated (see arrow 52, FIG. 5), front and rear arms 37, 41 rotate with respect to cylindrical bushing 32 as each of the arms 37, 41 is attached to longitudinal rod 33 (see FIGS. 2-3). The transverse rod 35 lifts bushing 36, rod 33, and rotates front arm 37 while also rotating longitudinal rod 33 to which front arm 37 is connected. This rotation of front arm 37 and longitudinal rod 33 also rotates rear arm 41.

Because rear arm 41 is attached to rear end portion 22 of frame 20 at rear bushing 42, frame 20 is elevated (see arrow 54) while maintaining its attitude with respect to an underlying support surface (e.g. road) 55. The front and rear arms 37, 41 lift front 21 and rear 22 end portions of frame 20 simultaneously and at substantially equal elevational positions.

Forward threaded rods 44, 45 are each provided with adjustment nuts 46, 47 respectively. Similarly, rear threaded rods 48, 49 are provided with adjustment nuts 50, 51 respectively. The threaded rods 44, 45, 48, 49 provide a fine adjustment for finely adjusting the position of shaped plate 30 and forward plate 53 to thus fine tune the shape of a curb C that is produced as the apparatus 10 moves in the direction of arrow 40 in FIG. 8.

Guide rod 60 is an optional, elongated substantially horizontally extending rod having transverse sections 61. An operator can rotate the transverse section 61 until is tracking the edge of an area (for example street, driveway, parking lot) to be curbed. The operator of the tractor 11 ensures that transverse section 61 travels along a selected path so that by definition, the curb C formed by apparatus 10 will also track a selected path.

During use, a cement mixer vehicle 62 having a delivery chute 63 can travel in front of the apparatus 10 of the present invention continuously adding wet concrete to the hopper 20 as needed while ensuring that it does not empty nor overflow.

Figure 9:
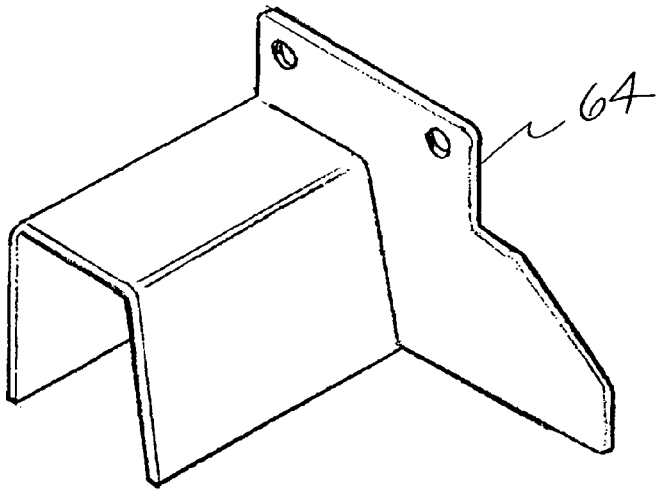
FIG. 9 is a fragmentary view of the preferred embodiment of the apparatus of the present invention.

FIG. 9 shows an alternate construction for a curb forming section, designated by the numeral 64.

The following is a list of parts and materials suitable for use in the present invention.

PARTS LIST

| Part Number | Description |
|---|---|
| 10 | curbing machine |
| 11 | excavator |
| 12 | motor driven frame |
| 13 | left track |
| 14 | right track |
| 15 | front end portion |
| 16 | rear end portion |
| 17 | mounting plate |
| 18 | T-shaped socket |
| 19 | hanger |
| 19A | horizontal flange |
| 19B | vertical flange |
| 19C | vertical flange |
| 20 | frame |
| 21 | front end portion |
| 22 | rear end portion |
| 23 | hopper |
| 24 | upper end portion |
| 25 | lower end portion |
| 26 | hollowed interior |
| 27 | upper opening |
| 28 | lower opening |
| 29 | curb forming section |
| 30 | shaped plate |
| 31a | section |
| 31b | section |
| 31c | section |
| 31d | section |
| 32 | cylindrical bushing |
| 33 | longitudinal rod |
| 34 | blade |
| 35 | transverse rod |
| 36 | transverse bushing |
| 37 | front arm |
| 38 | front bushing |
| 39 | rod |
| 40 | arrow |
| 41 | rear arm |
| 42 | rear bushing |
| 43 | rod |
| 44 | forward threaded rod |
| 45 | forward threaded rod |
| 46 | adjustment nut |
| 47 | adjustment nut |
| 48 | rear threaded rod |
| 49 | rear threaded rod |
| 50 | adjustment nut |
| 51 | adjustment nut |
| 52 | arrow |
| 53 | forward plate |
| 54 | arrow |
| 55 | underlying support surface |
| 56 | longitudinal bushing |
| 60 | guide rod |
| 61 | transverse section |
| 62 | cement mixer vehicle |
| 63 | chute |
| 64 | curb forming section |
| 65 | sleeve |
| 66 | set bolt |
| 67 | set screw |
| c | curb |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. Apparatus for forming an elongated concrete curb, comprising:

a) a frame having front and rear end portions, the frame supporting a hopper having upper and lower end portions, the hopper having a hollowed interior that includes upper and lower openings;

b) the frame having a curb shaping portion positioned next to the hopper lower opening;

c) a motor driven vehicle having a pair of endless tracks that propel the vehicle and move the frame along a selected path, each track having a track periphery, the vehicle having a liftable portion that is movable between lowered and elevated positions; and d) a connection that connects the frame to the motor driven vehicle on one side of the vehicle, including a connector on the vehicle within the track periphery and a lifting interface that connects between the vehicle liftable portion and the frame and that elevates the hopper while maintaining the attitude of the curb shaping portion during curbing operations and relative to horizontal.

2. The apparatus for forming an elongated concrete curb of claim 1 wherein the hopper upper end portion has a transverse cross section and the hopper lower end portion has a transverse cross section that is smaller than the transverse cross section of the hopper upper end portion.

3. The apparatus for forming an elongated concrete curb of claim 1 wherein curb shaping portion is movably adjustable into multiple selected positions.

4. The apparatus for forming an elongated concrete curb of claim 1 wherein the lifting interface includes a hydraulically powered lifting device.

5. The apparatus for forming an elongated concrete curb of claim 1 wherein the frame is not supported in front of nor behind the tractor.

6. Apparatus for forming elongated concrete curbs, comprising:

a) a frame having front and rear end portions, the frame supporting a hopper having upper and lower end portions, the hopper having a hollowed interior that includes upper and lower openings;

b) the frame rear end portion having an adjustable curb shaping portion that extends from the frame next to the hopper lower opening;

c) a motor driven tractor for moving the frame along a selected path;

d) a connection that connects the frame to the motor driven tractor the connection including interlocking portions on the vehicle and on the frame that interlock when the vehicle travels relative to the frame in a first direction and that disengage when the vehicle travels relative to the frame in a second direction generally opposite said first direction; and e) the connection including a lifting interface that includes a blade on the tractor, the interface elevating the hopper as the blade elevates while maintaining the attitude of the curb shaping portion during curbing operations and relative to horizontal.

7. The apparatus of claim 6 further comprising a guide bar that is generally parallel with the central longitudinal axis of the frame and that at least in part, extends in front of the combination of frame and tractor.

8. The apparatus for forming an elongated concrete curb of claim 6 wherein the hopper upper end portion has a transverse cross section and the hopper lower end portion has a transverse cross section that is smaller than the transverse cross section of the hopper upper end portion.

9. The apparatus for forming an elongated concrete curb of claim 6 wherein one or more adjustment rods that extend between the frame and the curb shaping portion and that support the curb shaping portion in selected positions.

10. The apparatus for forming an elongated concrete curb of claim 6 wherein the tractor has a pair of spaced apart, endless tracks that engage an underlying support surface.

11. The apparatus for forming an elongated concrete curb of claim 6 wherein the tractor is a tracked vehicle.

12. The apparatus for forming an elongated concrete curb of claim 6 wherein the lifting interface includes a hydraulically powered lifting device.

13. The apparatus for forming an elongated concrete curb of claim 6 wherein the tractor has left and right sides and the frame is supported laterally of one side of the tractor.

14. The apparatus for forming an elongated concrete curb of claim 6 wherein the frame is supported along one side of the tractor.

15. The apparatus for forming an elongated concrete curb of claim 6 wherein the tractor is a tracked vehicle having left and right tracks and the frame is supported by the tractor laterally of the tracks.

16. The apparatus for forming an elongated concrete curb of claim 6 wherein the frame is not supported in front of nor behind the tractor.

17. Apparatus for forming an elongated concrete curb, comprising:

a) a frame having front and rear end portions, the frame supporting a hopper having upper and lower end portions, the hopper having a hollowed interior that includes upper and lower openings;

b) the frame having a curb shaping portion positioned next to the hopper lower opening;

c) a motor driven excavator for moving the frame along a selected path, the excavator vehicle having a liftable excavating implement that is movable between lowered and elevated positions; and d) a connection that connects the frame to the vehicle along one side of the vehicle, wherein said implement being removably connectable to the frame so that elevation of the implement elevates the frame.

18. The apparatus for forming an elongated concrete curb of claim 17 wherein the frame is not supported in front of nor behind the tractor.

19. The apparatus of claim 17 further comprising a guide bar that is generally parallel with the central longitudinal axis of the frame and that at least in part, extends in front of the combination of frame and vehicle.

20. The apparatus for forming an elongated concrete curb of claim 17 wherein the hopper upper end portion has a transverse cross section and the hopper lower end portion has a transverse cross section that is smaller than the transverse cross section of the hopper upper end portion.

21. The apparatus for forming an elongated concrete curb of claim 17 wherein curb shaping portion is movably adjustable into multiple selected positions.

22. The apparatus for forming an elongated concrete curb of claim 17 wherein the vehicle is a tracked vehicle.

* * * * *